US006798999B2

(12) United States Patent
Itagaki et al.

(10) Patent No.: US 6,798,999 B2
(45) Date of Patent: Sep. 28, 2004

(54) IMAGE FORMING APPARATUS

(75) Inventors: Seiko Itagaki, Hachioji (JP); Kunio Shigeta, Hachioji (JP); Hiroshi Akita, Hachioji (JP)

(73) Assignee: Konica Corporation, Tokyo (JP)

( * ) Notice: Subject to any disclaimer, the term of this patent is extended or adjusted under 35 U.S.C. 154(b) by 0 days.

(21) Appl. No.: 10/439,032

(22) Filed: May 14, 2003

(65) Prior Publication Data

US 2003/0219266 A1 Nov. 27, 2003

(30) Foreign Application Priority Data

May 24, 2002 (JP) ..... 2002-150464

(51) Int. Cl.[7] ..... G03G 15/00
(52) U.S. Cl. ..... 399/38; 399/48; 399/49
(58) Field of Search ..... 399/38, 46, 48, 399/49, 60

(56) References Cited

U.S. PATENT DOCUMENTS 5,235,385 A * 8/1993 Rushing ..... 399/55
5,812,903 A * 9/1998 Yamada et al. ..... 399/42
6,034,703 A * 3/2000 Broddin et al. ..... 347/131

* cited by examiner

*Primary Examiner*—Hoan Tran
(74) *Attorney, Agent, or Firm*—Cohen, Pontani, Lieberman & Pavane

(57) ABSTRACT

This invention relates to an image forming apparatus which forms an image on a transfer medium using a two-component developing agent by electrophotography. An image forming apparatus according to this invention includes a potential sensor which measures the charging potential on an image forming body and a patch density sensor which detects the toner attraction amount of a patch image. In the image forming apparatus, a toner charge amount Qt ($\mu$C/g) is calculated from the potential of a patch image before and after development detected by the potential sensor and the image density of a developed patch image detected by the patch density sensor, and image formation is performed by setting image formation conditions based on the calculated toner charge amount Qt. To set the image formation conditions, a table which stores in advance an image formation condition corresponding to the toner charge amount Qt is used.

14 Claims, 8 Drawing Sheets

IMAGE FORMING APPARATUS

BACKGROUND OF THE INVENTION

1. Field of the Invention

The present invention relates to an image forming apparatus for forming an image on transfer paper in accordance with electrophotography and, more particularly, to an image forming apparatus which performs development using a two-component developing agent.

2. Description of the Prior Art

As an example of an image forming process of forming an image by electrophotography, there is known a process of forming an electrostatic latent image on an image forming body such as a photosensitive body, developing the formed electrostatic latent image by a developing means to form a toner image on the image forming body, transferring the formed toner image onto transfer paper by a transfer means, and fixing the transferred toner image on the transfer paper by a fixing means to form an image on the transfer paper. Another example is known as a process of transferring a toner image on an image forming body such as a photosensitive body onto an intermediate transfer body serving as an image carrier, transferring the toner image from the intermediate transfer body onto transfer paper by a transfer means, and fixing the transferred toner image on the transfer paper to form an image on the transfer paper.

In the developing step of the above-mentioned conventional image forming process, development using a two-component developing agent containing nonmagnetic toner and a magnetic carrier is often employed, and a developing bias voltage obtained by superposing an AC-bias voltage on a DC-bias voltage is applied.

In development using the two-component developing agent, since only the toner is consumed by development, an appropriate amount of new toner corresponding to the consumed amount must be replenished. Thus, toner replenishment is performed.

Newly replenished toner together with a magnetic carrier is stirred by a stirring means, e.g., a stirring convey screw, a rotary paddle which is like a water wheel, or the like, and mutual friction causes the toner to be charged due to triboelectrification. For this reason, if stirring is not satisfactorily performed, and the toner with charge of less than a predetermined value makes visible an electrostatic latent image, part of the toner is attracted to white portions of an image forming body, i.e., so-called fogging occurs in the image.

Particularly, in an apparatus which employs a toner recycling scheme, recycle toner is often more deteriorated than newly replenished toner and tends to cause the above-mentioned inconvenient phenomenon. When toner having a small particle size or toner manufactured by a polymerization method and having a sharp particle size distribution is used, an image quality (e.g., resolution, tone, and character reproducibility) is high. Therefore, the above inconvenient phenomenon tends to be obvious.

For the image formation conditions of development, transfer, and the like, whether an image is satisfactorily formed substantially depends on the charge amount of toner. However, conventionally, the state of a developing agent is predicted from the use environment, life, and use condition of toner, and the developing conditions and the like are set using a table prepared in advance. A technique is also used for obtaining a suitable image density by changing the developing conditions based on a patch density generated in image adjustment mode. In these methods, the image formation conditions are not set based on the toner charge amount obtained by direct calculation. For this reason, to increase the image density, an image may be developed excessively to cause a problem such as fogging and the like. Particularly, when toner having a small particle size is used, the developing characteristics vary greatly, and when control is performed only by image density detection, an image with a stable image quality cannot be obtained.

SUMMARY OF THE INVENTION

It is an object of the present invention to provide an image forming apparatus capable of obtaining a toner charge amount to set optimum image formation conditions based on the obtained toner charge amount.

To achieve the above-mentioned object, according to the first aspect of the present invention, there is provided an image forming apparatus including an image forming body, electrostatic latent image forming means for charging the image forming body to a charging potential Vh (V) by charging means and exposing the image forming body by exposure means to form an electrostatic latent image on the image forming body, developing means for using a two-component developing agent and applying a developing bias voltage obtained by superposing an AC-bias voltage on a DC-bias voltage Vdc (V) to a developing agent carrier to develop the electrostatic latent image formed on the image forming body, thereby forming a toner image on the image forming body, transfer means for transferring the toner image formed on the image forming body onto a recording medium or an intermediate transfer body, cleaning means for cleaning part of the toner image which is not transferred and left on the image forming body, and a controller which controls operation of each of the means, comprising a potential sensor which measures a charging potential on the image forming body, and a patch density sensor which detects a toner attraction amount of a patch image, wherein to perform image formation, the controller calculates a toner charge amount Qt ($\mu$C/g) from a potential of a patch image before and after development detected by the potential sensor and an image density of a developed patch image detected by the patch density sensor and sets an image formation condition based on the calculated toner charge amount Qt.

According to the second aspect of the present invention, there is provided an image forming apparatus, wherein setting of the image formation condition according to the first aspect is performed using a table which stores in advance the image formation condition corresponding to-the toner charge amount Qt. According to the third aspect of the present invention, there is provided an image forming apparatus, wherein the image formation condition stored in the table according to the second aspect is a difference (Vh−Vdc) between the charging potential Vh (V) and the DC-bias voltage Vdc (V).

According to the fourth aspect of the present invention, there is provided an image forming apparatus, wherein the image formation condition stored in the table according to the second aspect is a peak value Vacp-p (V) of the AC-bias voltage.

According to the fifth aspect of the present invention, there is provided an image forming apparatus, wherein the image formation condition stored in the table according to the second aspect is a frequency Fac (kHz) of the AC-bias voltage.

According to the sixth aspect of the present invention, there is provided an image forming apparatus, wherein the image formation condition stored in the table according to the second aspect is the DC-bias voltage Vdc (V).

According to the seventh aspect of the present invention, there is provided an image forming apparatus, wherein the image formation condition stored in the table according to the second aspect is a value vs/vp obtained by dividing a peripheral velocity vs (mm/s) of the developing agent carrier by a peripheral velocity vp (mm/s) of the image forming body.

According to the eighth aspect of the present invention, there is provided-an image forming apparatus, wherein the image formation condition stored in the table according to the second aspect is a transfer current Itr (A) used when transferring the toner image onto the recording medium or the immediate transfer body.

According to the ninth aspect of the present invention, there is provided an image forming apparatus, wherein setting of the image formation condition according to the first aspect is performed in image adjustment mode.

According to the 10th aspect of the present invention, there is provided an image forming apparatus, wherein the image formation condition according to the first aspect comprises a plurality of different image formation conditions corresponding to the toner charge amount Qt, and the plurality of image formation conditions are simultaneously set using a plurality of tables which store in advance the plurality of image formation conditions, respectively.

According to the 11th aspect of the present invention, there is provided an image forming apparatus, wherein setting of the image formation condition according to the second or 10th aspect is performed in image adjustment mode.

According to the 12th aspect of the present invention, there is provided an image forming apparatus according to the first or second aspect, wherein the two-component developing agent comprises a magnetic carrier and nonmagnetic polymerized toner having a volume average particle size of 3 $\mu$m to 6.5 $\mu$m.

As can be seen from the above-mentioned aspects, according to an image forming apparatus of the present invention, the toner charge amount is obtained, and the image formation conditions are set based on the obtained image formation conditions, unlike a conventional method of setting the image formation conditions. For this reason, more suitable development conditions or transfer conditions are set compared to conventional apparatuses, and thus sharp, satisfactory images can be obtained.

The above and many other objects, features and advantages of the present invention will become manifest to those skilled in the art upon making reference to the following detailed description and accompanying drawings in which preferred embodiments incorporating the principle of the present invention are shown by way of illustrative examples.

DETAILED DESCRIPTION OF THE PREFERRED EMBODIMENTS

Several preferred embodiments of the present invention will be described below with reference to the accompanying drawings.

Figure 1:
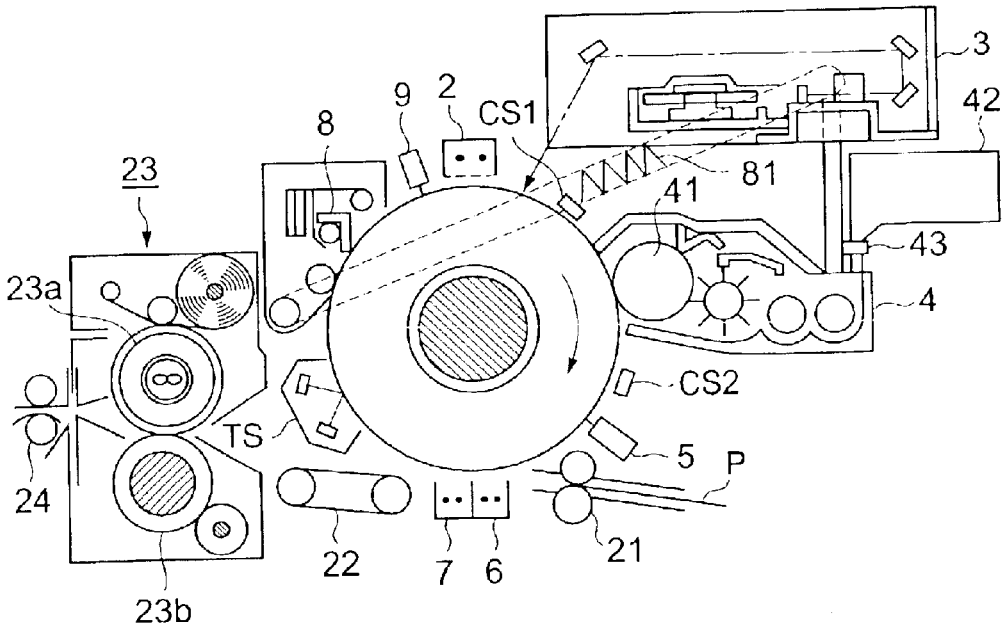
FIG. 1 is an elevation showing the arrangement of the main part of an image forming apparatus of the present invention.

FIG. 1 shows a copying machine and, in particular, its image forming portion that utilizes electro-photographic process of forming a monochrome image as a specific example of an image forming apparatus of the present invention. Note that the present invention is not limited to the arrangement shown in FIG. 1 and is also applied to a color image forming apparatus.

Reference numeral 1 denotes a drum-like photosensitive body serving as an image forming body. In the photosensitive body 1, as an organic semiconductor layer to be negatively charged, a phthalocyanine pigment dispersed in polycarbonate is applied to a cylinder-like metal substrate which is grounded. The thickness of the photosensitive body layer including a charge transport layer is 30 $\mu$m. The drum has a diameter of 80 mm, and is rotatably driven at a peripheral velocity (vp) of 280 mm/s in the direction of an arrow.

Reference numeral 2 denotes a scorotron charging means for uniformly charging the outer surface of the rotating photosensitive body 1 to a predetermined polarity and potential. The charging means 2 forms a charging electrode arrangement in which the distance between the wire and grid is 7.5 mm, the distance between the grid and photosensitive body is 1 mm, and the distance between the wire and back plate is 12 mm. The charging means 2 applies a bias voltage to the photosensitive body 1 with a grid application voltage of −730 V and a charging current value of −800 $\mu$A, thus setting a charging potential Vh of the photosensitive body 1 to −750 V.

Reference numeral 3 denotes an image exposing means employing a laser scanning scheme. The image exposing means 3 uses a semiconductor laser (LD) having a laser wavelength of 700 nm, and its output power is 300 $\mu$W. The image exposing means 3 emits a laser beam to scan and expose the uniformly charged surface of the photosensitive body 1, thus forming an electrostatic latent image.

A developing unit 4 develops the electrostatic latent image on the photosensitive body 1 as a toner image by a developing agent carrier 41 which rotates in a direction opposite to that of the photosensitive body 1. Contact or non-contact development is performed using a two-component developing agent by a combination of image exposure and reverse development. The developing agent carrier 41 is formed by covering the outer surface of a magnet roller with an aluminum sleeve having a surface coated with stainless steel by flame spray coating. The developing agent carrier 41 having a roller diameter of 40 mm is rotated at a linear velocity (vs) of 560 mm/s, so that its linear velocity ratio (vs/vp) to the photosensitive body 1 is 2. The developing agent carrier 41 performs development upon reception of a DC-component developing bias voltage. Reverse development is performed by superposing a peak value Vacp-p (kVp-p) of a AC-bias voltage at a frequency (Fac) of 2 kHz as the AC component on a DC-bias voltage (Vdc) of −600 V as the DC component.

As the toner of the two-component developing agent containing the nonmagnetic toner and magnetic carrier, polymerized toner having a volume average particle size of 3 μm to 6.5 μm is preferable. When polymerized toner is used, an image forming apparatus with high resolution and stable density which causes very few fogging becomes possible.

The polymerized toner is manufactured by the following manufacturing method.

A toner binder resin is produced and its toner shape is formed by polymerization of a material monomer or prepolymer for the binder resin and a subsequent chemical process. More specifically, the toner binder resin is obtained by polymerization reaction such as suspension polymerization or emulsion polymerization, and a subsequent particle fusing step which is performed when necessary. Regarding the polymerized toner, the material monomer or prepolymer is uniformly dispersed in a water system and is thereafter polymerized, thus manufacturing the toner. As a result, spherical toner having a uniform particle size distribution and uniform shape can be obtained.

A shape factor SF-1 indicating the spherical degree of the toner is preferably between 100 and 140, and a shape factor SF-2 indicating the degree of nonuniformity of the toner is preferably between 100 and 120. The shape factors SF-1 and SF-2 are given by the following equations:

$$SF\text{-}1=(L\max^2/A)\times(\pi/4)\times 100$$

$$SF\text{-}2=(L\text{around}^2/A)\times(1/4\pi)\times 100$$

where Lmax: the maximum diameter, Laround: the circumferential length, and A: the toner projection area When the volume average particle size of the toner becomes less than 3 μm, fogging or toner scattering tends to occur. The upper limit of 6.5 μm is the upper limit of the particle size that enables high image quality that this embodiment is aimed at.

As the carrier, a ferrite core carrier formed of magnetic particles with a volume average particle size of 30 μm to 65 μm and a magnetization amount of 20 emu/g to 70 emu/g is preferable. With a carrier having a particle size smaller than 30 μm, carrier attraction tends to occur. With a carrier having a particle size larger than 65 μm, an image with a uniform density may not be formed.

Reference numeral 5 denotes a pre-transfer exposure light source for irradiating the toner image in order to improve its transfer performance. Irradiation is performed with an LED having a light wavelength of 700 nm at a light output of 10 lux.

Reference numeral 6 denotes a corotron transfer electrode. With the transfer electrode 6, the distance between the wire and photosensitive body 1 is 8 mm and the distance between the wire and back plate is 12 mm. The transfer electrode 6 transfers the toner image on the photosensitive body 1 onto the transfer paper by constant current control with a transfer current (Itr) of 200 μA.

Reference numeral 7 denotes a corotron separation electrode. With the separation electrode 7, the distance between the wire and photosensitive body 1 is 8 mm and the distance between the wire and back plate is 12 mm. The separation electrode 7 promotes separation of the transfer paper from the photosensitive body 1 by a separation current with an AC component of 1000 μA and a DC component of −200 μA.

Transfer paper P supplied from a paper supply unit is supplied by registration rollers 21 in synchronism with the toner image formed on the photosensitive body 1, and the toner image is transferred to it at a transfer nip portion by the transfer electrode 6. The transfer paper P passing through the transfer nip portion is separated from the surface of the photosensitive body 1 by the separation electrode 7, and is conveyed to a fixing unit 23 by a conveyor belt 22.

The fixing unit 23 consists of a heat roller 23*a* incorporating a heater, and a press roller 23*b*. The transfer paper P bearing the toner image is heated and pressurized between the heat roller 23*a* and press roller 23*b*, so that the toner image is fixed. The transfer paper P to which the toner image is fixed is delivered by delivery rollers 24 onto a delivery tray outside the copying machine.

The surface of the photosensitive body 1, from which the toner image has been transferred to the transfer paper P, is cleaned by a cleaning unit 8 to remove the transfer residue toner. In this embodiment, a blade made of urethane rubber is used as the cleaning means. The cleaning blade is of a counter type which comes into slidable contact with the outer surface of the photosensitive body 1 to clean it. The outer surface of the photosensitive body 1, which has been cleaned while passing through the cleaning unit 8, is irradiated by a pre-charging exposing (PCL) means 9 using a light source having a light wavelength of 700 nm and a light output of 10 lux, so the residual potential is decreased. After that, the process moves to the next image formation cycle.

The toner collected by the cleaning unit 8 is recovered in the developing unit 4 by a toner recycling means 81 which conveys the toner by rotation of a convey screw or the like. The recovering operation into the developing unit 4 is performed in parallel with the rotating operation of the photosensitive body 1 In an image forming apparatus according to the present invention, potential sensors CS which measure the potential on the photosensitive body 1 and a patch density sensor TS which measures the toner attraction amount of a patch image on the photosensitive body 1 are provided A toner charge amount Qt (μC/g) is calculated using the potential sensors CS and patch density sensor TS. The calculation of the toner charge amount will be described below in detail.

In the image forming apparatus according to the present invention, potential sensors CS1 and CS2 are provided upstream and downstream of the developing unit 4 to face the photosensitive body 1, and both the potential sensors C1 and C2, having undergone satisfactory sensitivity adjustment, keep the adjusted state. The patch density sensor TS which measures the toner attraction amount in a patch image on the photosensitive body 1 by detecting the reflection density on the photosensitive body 1 is provided between the developing unit 4 and the cleaning unit 8. The patch density sensor TS is also used to detect the density of a patch image and control supply of toner to the developing unit 4.

Figure 2:
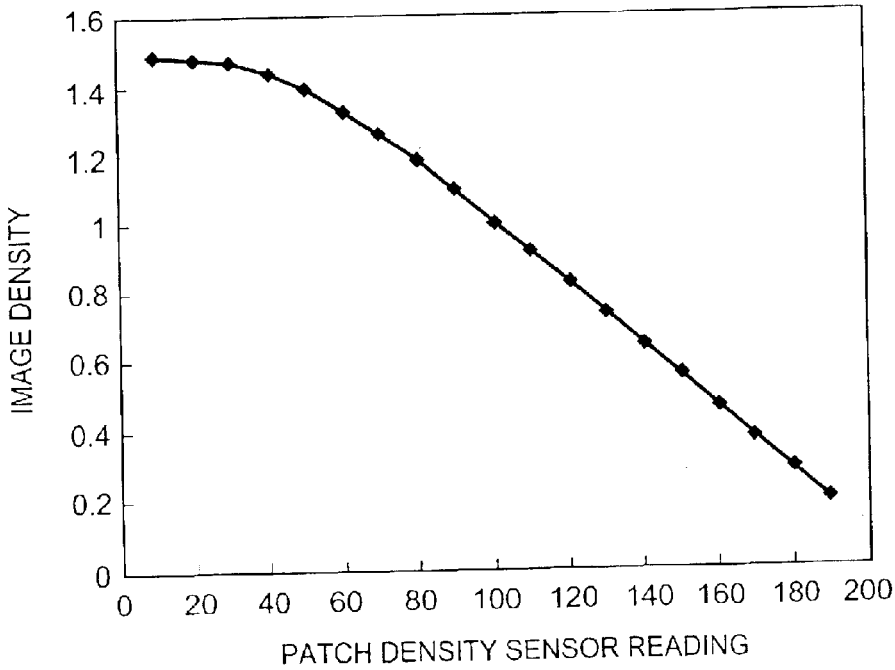
FIG. 2 is a graph showing the relationship between the reading of a patch density sensor and the image density.

In image adjustment mode, a patch image is formed, and the potential sensors CS1 and CS2 measure the potential of the patch image portion before and after development. As the patch image, a non-solid test pattern of halftone density is employed. More specifically, a non-solid test pattern, which has a visualized image having a printing rate of between 30% and 70% or a reflection density of 0.4 to 0.9 in printing and does not decrease the sensitivity of the patch density sensor TS, is employed. FIG. 2 shows the relationship between the reading obtained by the patch density sensor TS and the image density. Referring to FIG. 2, in a region in which a characteristic curve indicating the relationship between the sensor reading and the image density linearly extends, the image density and the toner attraction amount are kept almost proportional to each other.

Even if the image density is the same, the toner attraction amount varies depending on the toner properties. Assume that toner having a small particle size is used. In this case, even when the toner attraction amount is smaller than that of toner having a large particle size, the image density is detected to be the same. For this reason, in the image forming apparatus according to the present invention, a test is performed in advance using a developing agent to be used, and a table showing the relationship between the toner attraction amount and the sensor reading obtained by the patch density sensor TS is stored as a memory.

Figure 3:
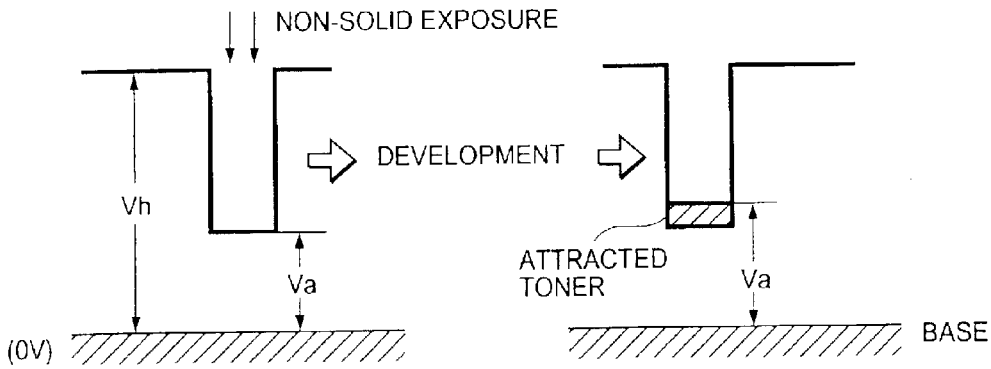
FIG. 3 is a view for explaining the state of the potential of a patch image.

FIG. 3 is an explanatory view schematically showing the state of the potential of a patch image to be detected by the potential sensors CS1 and CS2. Non-solid exposure is performed for a patch portion, which has uniformly been charged at a charging potential Vh by the charging means 2, and a potential Va of the patch portion is detected by the potential sensor CS1. After the potential detection, the patch portion passes through the developing unit 4 to undergo development, and a potential Vb of the patch portion, to which some toner has been attracted, is detected. A value obtained by subtracting the potential Va from the potential Vb using the absolute value is derived from the attraction of the charged toner. Note that since potential detection by the potential sensor CS2 lags behind that by the potential sensor CS1, errors due to dark decay of the photosensitive body 1 is corrected in calculation.

For the patch portion having the attracted toner, which has undergone potential detection by the potential sensor CS2, the patch density sensor TS detects a sensor reading. A controller obtains a toner attraction amount Mt from a table recorded as a memory and showing the relationship between the sensor reading and the toner attraction amount and divides a potential difference (Vb−Va) by the toner attraction amount Mt, thereby calculating the toner charge amount Qt ($\mu$C/g).

The above-mentioned process of calculating a toner charge amount is recorded in a memory as a toner charge amount calculation program. In image adjustment mode, the toner charge amount Qt is obtained by the above toner charge amount calculation program under the standard image formation conditions described above, and each image formation condition to be described next is set based on the obtained toner charge amount Qt.

Note that if image formation is satisfactorily performed under the above standard image formation conditions, and toner has a small particle size to satisfy the average conditions, the toner charge amount Qt is 30 $\mu$C/g.

In the image forming apparatus of the present invention, the two potential sensors CS1 and CS2 are used to calculate the toner charge amount Qt. The toner charge amount Qt can be obtained using the potential sensor CS1 alone on the upstream side. In this case, the photosensitive body 1 is separated from the blade of the cleaning unit 8, and the potential of the patch portion before development is measured. After that, when the developed patch portion having attracted toner is rotated once to reach the potential sensor CS1, potential detection is performed. This enables calculation of the toner charge amount before and after development.

Several embodiments that pertain to the setting of the image formation conditions in an image forming apparatus of the present invention will be described next.

First Embodiment:

First, a toner charge amount Qt is obtained in image adjustment mode. By using a separately prepared Qt: (Vh−Vdc) table showing the relationship between the toner charge amount Qt and the fogging margin (Vh−Vdc), which is a difference between a charging voltage Vh and a developing bias voltage (a DC-bias voltage Vdc), the optimum fogging margin is set based on the obtained toner charge amount Qt.

Figure 4:
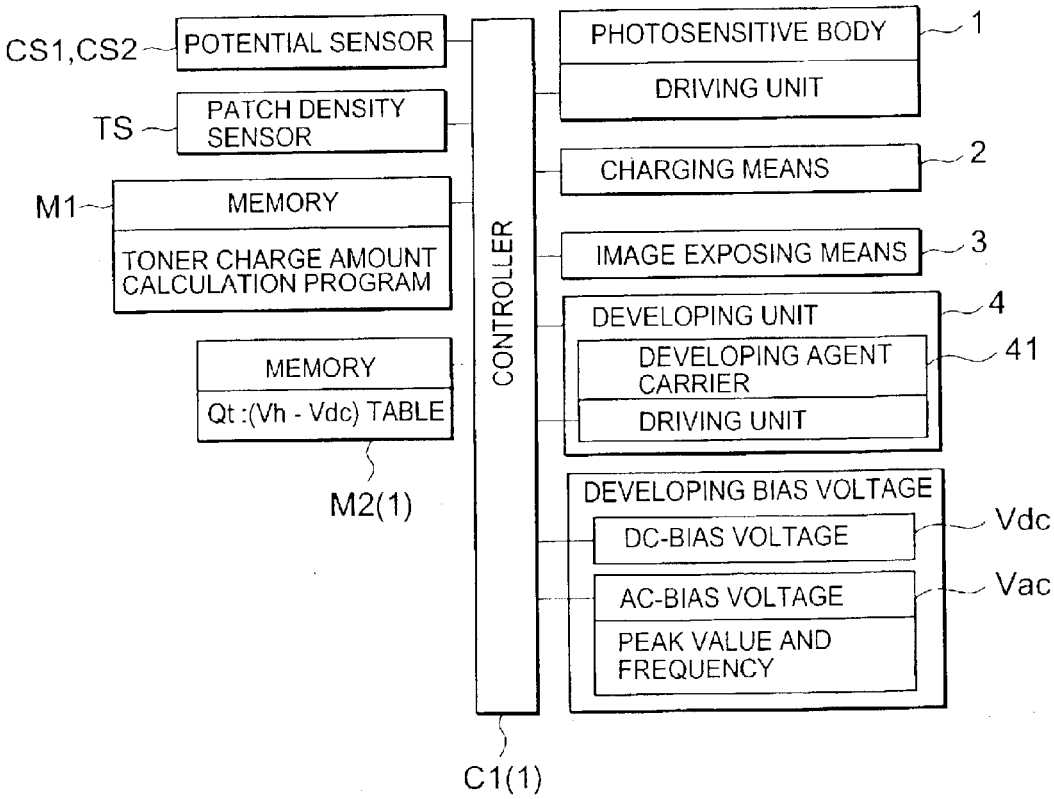
FIG. 4 is a control block diagram of an image forming apparatus according to claim 1 of the present invention.
Figure 5:
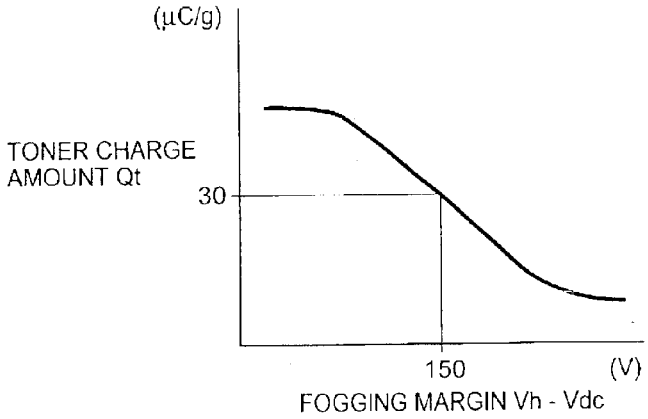
FIG. 5 is a graph showing the relationship between the toner charge amount and the fogging margin.

FIG. 4 shows the control block diagram of the first embodiment, and FIG. 5 shows a Qt: (Vh−Vdc) table as a graph.

In image adjustment mode, a controller C1 (1) calls a toner charge amount calculation program recorded in a memory M1 and forms a patch image on a photosensitive body 1. The controller C1 detects the potential of a patch portion before and after development through potential sensors CS1 and CS2 and reads the reflection density by a patch density sensor TS, thereby obtaining the toner attraction amount. After that, the controller C1 calculates the toner charge amount by performing arithmetic operations.

The controller C1 (1) recalls the Qt: (Vh−Vdc) table from a memory M2 (1) and obtains the fogging margin (Vh−Vdc) corresponding to the detected, calculated toner charge amount from the Qt: (Vh−Vdc) table, thereby setting the image formation conditions. In this case, the fogging margin may be set by changing only the charging potential Vh (−750V in this embodiment), only the DC-bias voltage Vdc (−600V in this embodiment), or changing both the voltages.

In this manner, satisfactory development without fogging is performed by setting the fogging margin.

Second Embodiment:

As in the first embodiment, a toner charge amount Qt is obtained in image adjustment mode. By using a separately prepared Qt:Vacp-p table showing the relationship between the toner charge amount Qt and the peak value Vacp-p of an AC-bias voltage in a developing bias voltage, the optimum peak value of the AC-bias voltage is set based on the obtained toner charge amount Qt.

Figure 6:
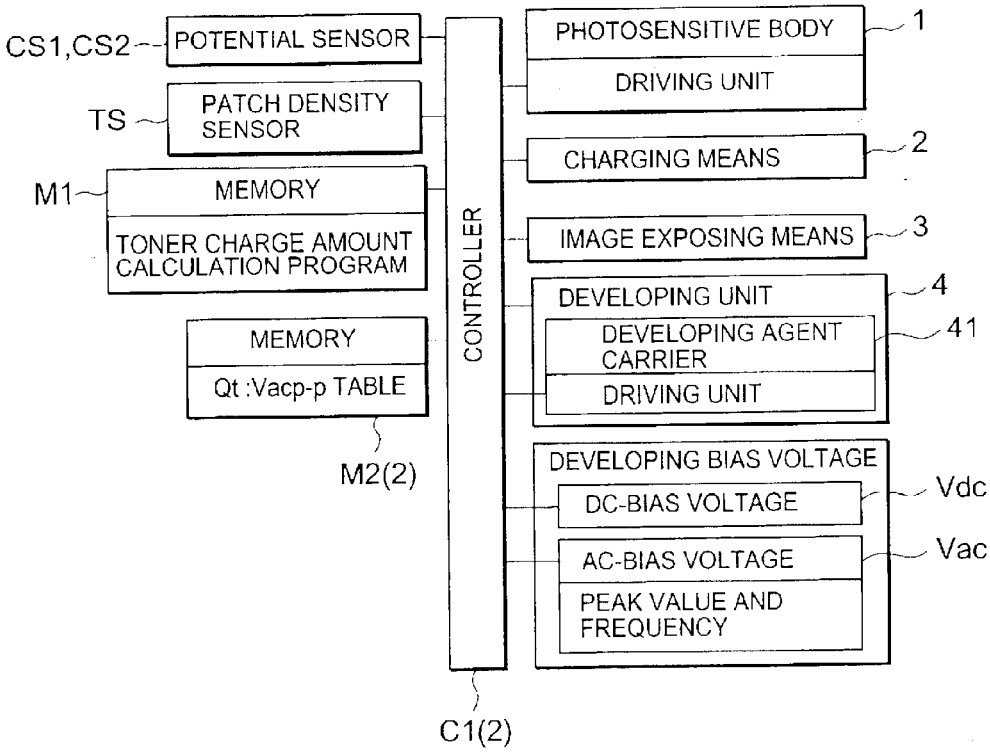
FIG. 6 is a control block diagram of an image forming apparatus according to claim 2 of the present invention.
Figure 7:
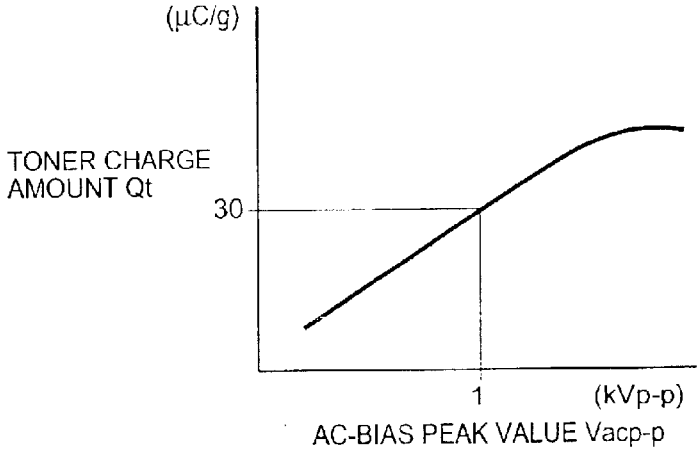
FIG. 7 is a graph showing the relationship between the toner charge amount and the peak value of an AC-bias voltage.

FIG. 6 shows the control block diagram of the second embodiment, and FIG. 7 shows a Qt:Vacp-p table as a graph.

In image adjustment mode, a controller C1 (2) calls a toner charge amount calculation program recorded in a memory M1 and forms a patch image on a photosensitive body 1. The controller detects the potential of a patch portion before and after development through potential sensors CS1 and CS2 and reads the reflection density by a patch density sensor TS, thereby obtaining the toner attraction amount. After that, the controller C1 calculates the toner charge amount by performing arithmetic operations.

The controller C1 (2) recalls the Qt:Vacp-p table from a memory M2 (2) and obtains the peak value of the AC-bias voltage corresponding to the detected, calculated toner charge amount from the Qt:Vacp-p table, thereby setting the image formation conditions.

Since the behavior of toner in development is greatly dependent upon the charged state of the toner, sharp development without fogging is performed by setting the peak value of the AC-bias voltage corresponding to the toner charge amount.

Third Embodiment:

As in the first embodiment, a toner charge amount Qt is obtained in image adjustment mode. By using a separately prepared Qt:Fac table showing the relationship between the toner charge amount Qt and a frequency Fac of an AC-bias voltage in a developing bias voltage, the optimum frequency of the AC-bias voltage is set based on the obtained toner charge amount Qt.

Figure 8:
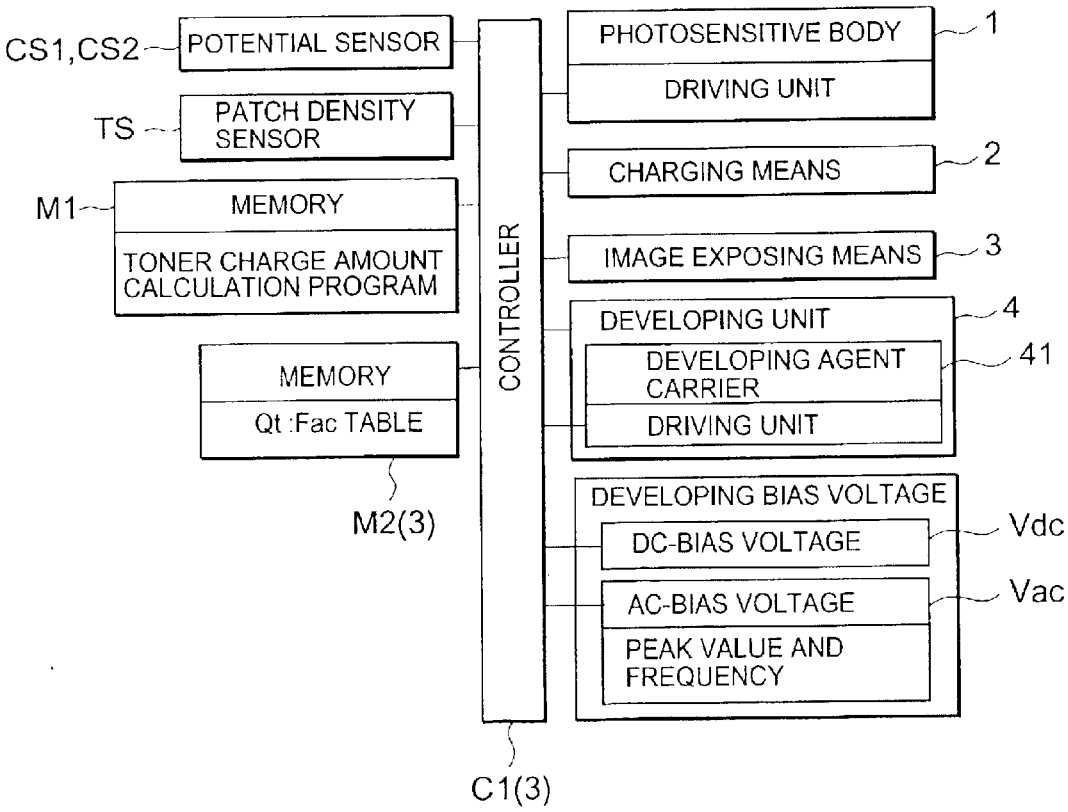
FIG. 8 is a control block diagram of an image forming apparatus according to claim 3 of the present invention.
Figure 9:
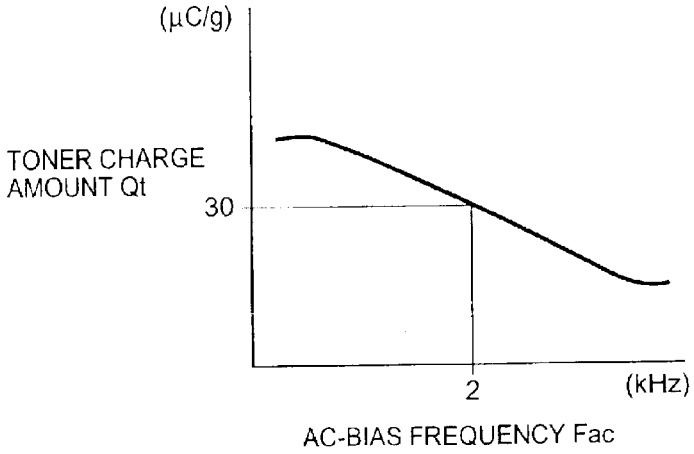
FIG. 9 is graph showing the relationship between the toner charge amount and the AC frequency.

FIG. 8 shows the control block diagram of the third embodiment, and FIG. 9 shows a Qt:Fac table as a graph.

In image adjustment mode, a controller C1 (3) calls a toner charge amount calculation program recorded in a memory M1 and forms a patch image on a photosensitive body 1. The controller C1 detects the potential of a patch portion before and after development through potential sensors CS1 and CS2 and reads the reflection density by a patch density sensor TS, thereby obtaining the toner attraction amount. After that, the controller C1 calculates the toner charge amount by performing arithmetic operations.

The controller C1 (3) recalls the Qt: Fac table from a memory M2 (3) and obtains the frequency of the AC-bias voltage corresponding to the detected, calculated toner charge amount Qt from the Qt:Fac table, thereby setting the image formation conditions.

Since the behavior of toner in development is greatly dependent upon the charged state of the toner, sharp development without fogging is performed by setting the frequency of the AC-bias voltage corresponding to the toner charge amount.

Fourth Embodiment:

As in the first embodiment, a toner charge amount Qt is obtained in image adjustment mode. By using a separately prepared Qt:Vdc table showing the relationship between the toner charge amount Qt and a DC-bias voltage Vdc in a developing bias voltage, the optimum DC-bias voltage is set based on the obtained toner charge amount Qt.

Figure 10:
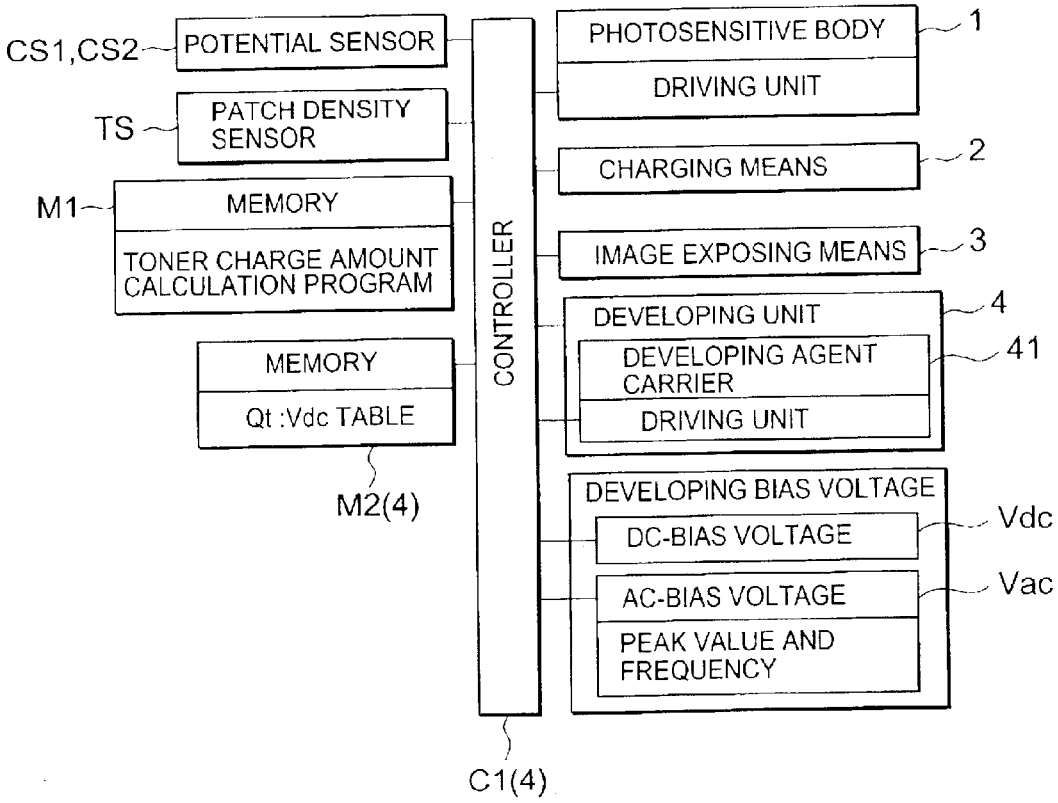
FIG. 10 is a control block diagram of an image forming apparatus according to claim 4 of the present invention.
Figure 11:
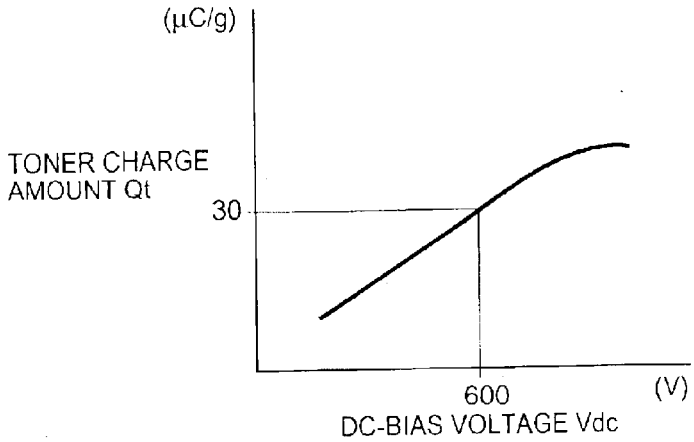
FIG. 11 is graph showing the relationship between the toner charge amount and the DC-bias voltage.

FIG. 10 shows the control block diagram of the fourth embodiment, and FIG. 11 shows a Qt:Vdc table as a graph.

In image adjustment mode, a controller C1 (4) calls a toner charge amount calculation program recorded in a memory M1 and forms a patch image on a photosensitive body 1. The controller C1 detects the potential of a patch portion before and after development through potential sensors CS1 and CS2 and reads the reflection density by a patch density sensor TS, thereby obtaining the toner attraction amount. After that, the controller C1 calculates the toner charge amount by performing arithmetic operations.

The controller C1 (4) recalls the Qt:Vdc table from a memory M2 (4) and obtains the DC-bias voltage corresponding to the detected, calculated toner charge amount from the Qt:Vdc table, thereby setting the image formation conditions. Note that the DC-bias voltage is represented using the absolute value in FIG. 11.

Since the behavior of toner in development is greatly dependent upon the charged state of the toner, sharp development without fogging is performed by setting the DC-bias voltage corresponding to the toner charge amount.

Fifth Embodiment:

As in the first embodiment, a toner charge amount Qt is obtained in image adjustment mode. By using a separately prepared Qt:vs/vp table showing the relationship between the toner charge amount Qt and a ratio vs/vp between a linear velocity vs of a developing agent carrier 41 and a linear velocity vp of a photosensitive body 1, the optimum linear velocity-ratio in development is set based on the obtained toner charge amount Qt.

Figure 12:
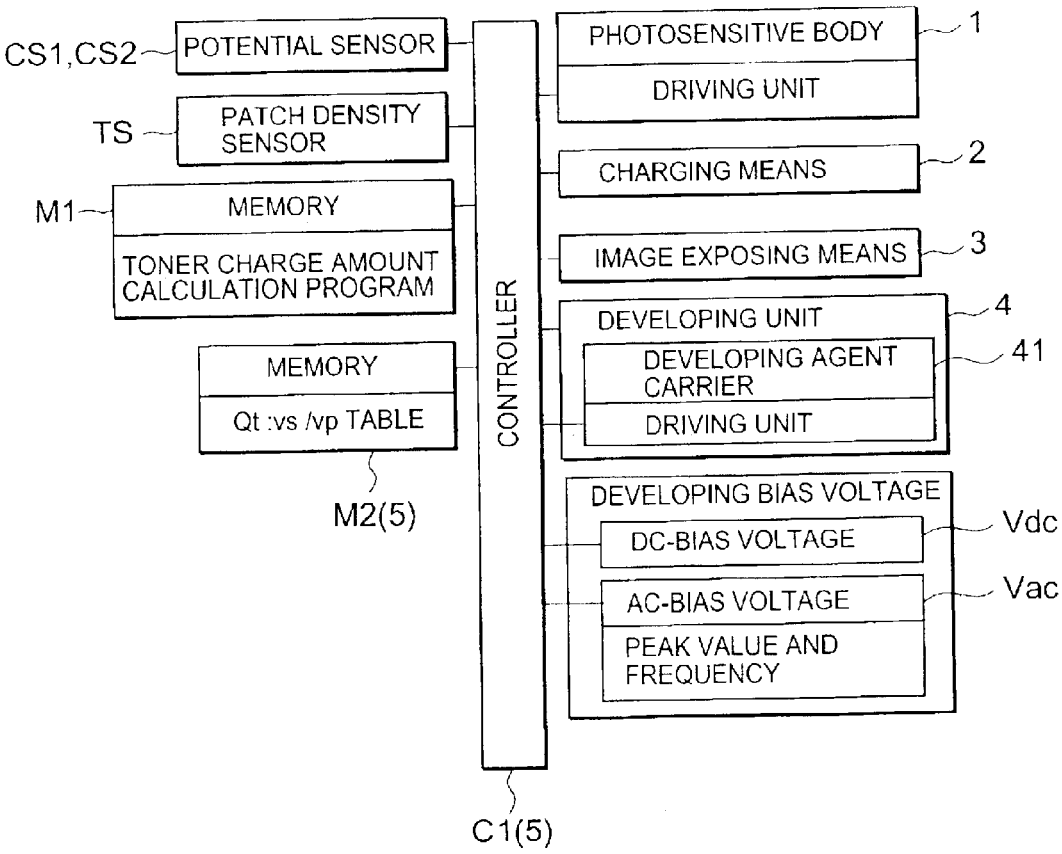
FIG. 12 is a control block diagram of an image forming apparatus according to claim 5 of the present invention.
Figure 13:
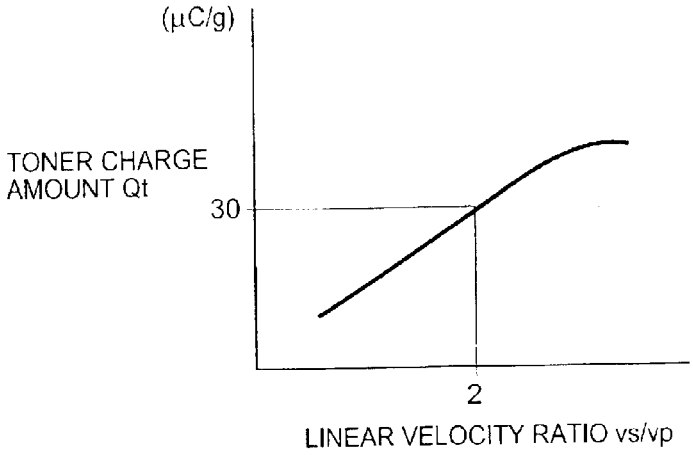
FIG. 13 is graph showing the relationship between the toner charge amount and the linear velocity ratio.

FIG. 12 shows the control block diagram of the fifth embodiment, and FIG. 13 shows a Qt:vs/vp table as a graph.

In image adjustment mode, a controller C1 (5) calls a toner charge amount calculation program recorded in a memory M1 and forms a patch image on a photosensitive body 1. The controller C1 detects the potential of a patch portion before and after development through potential sensors CS1 and CS2 and reads the reflection density by a patch density sensor TS, thereby obtaining the toner attraction amount. After that, the controller C1 calculates the toner charge amount by performing arithmetic operations.

The controller C1 (5) recalls the Qt:vs/vp table from a memory M2 (5) and obtains a vs/vp value corresponding to the detected, calculated toner charge amount from the Qt vs/vp table, thereby setting the rotational speed of the developing agent carrier 41 as an image formation condition.

Since the behavior of toner in development is greatly dependent upon the charged state of the toner, and the toner attraction amount for a latent image varies depending on the linear velocity vs/vp, sharp development at a suitable image density is performed by setting the vs/vp value corresponding to the toner charge amount.

Sixth Embodiment:

As in each of the above-mentioned embodiments, a toner charge amount Qt is obtained in image adjustment mode. By using a separately prepared Qt:Itr table showing the relationship between the toner charge amount Qt and a transfer current Itr of a transfer electrode 6 which performs transfer, the optimum transfer current value in transfer is set.

Figure 14:
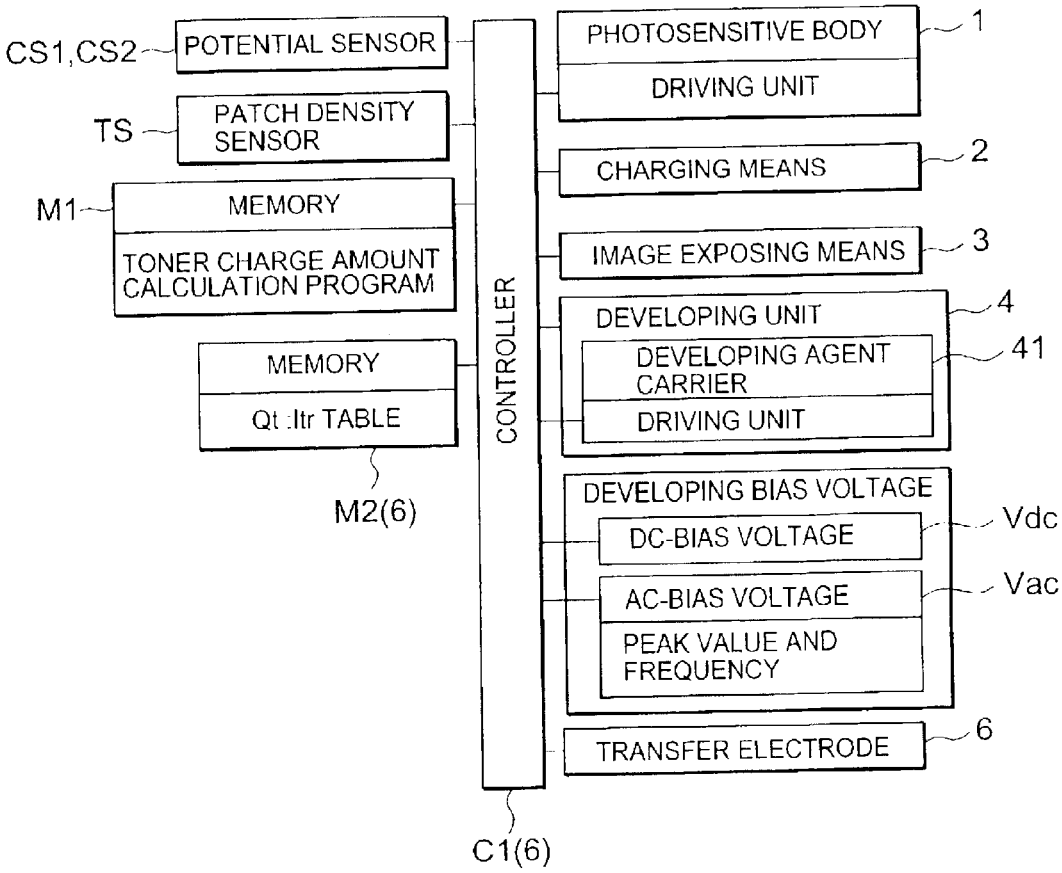
FIG. 14 is a control block diagram of an image forming apparatus according to claim 6 of the present invention.
Figure 15:
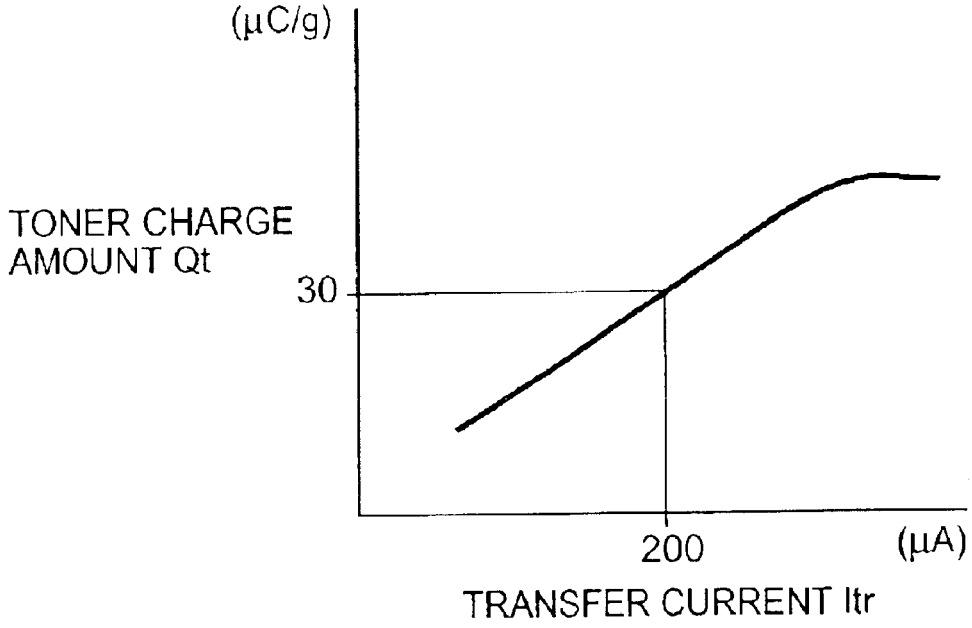
FIG. 15 is graph showing the relationship between the toner charge amount and the transfer current.

FIG. 14 shows the control block diagram of the sixth embodiment, and FIG. 15 shows a Qt:Itr table as a graph.

In image adjustment mode, a controller C1 (6) calls a toner charge amount calculation program recorded in a memory M1 and forms a patch image on a photosensitive body 1. The controller C1 detects the potential of a patch portion before and after development through potential sensors CS1 and CS2 and reads the reflection density by a patch density sensor TS, thereby obtaining the toner attraction amount. After that, the controller C1 calculates the toner charge amount by performing arithmetic operations.

The controller C1 (6) recalls the Qt:Itr table from a memory M2 (6) and obtains the transfer current value corresponding to the detected, calculated toner charge amount from the Qt:Itr table, thereby setting the value of a transfer current to be applied to the transfer electrode 6 in transfer as an image formation condition. Note that the transfer current value is represented using the absolute value in FIG. 15.

Since the behavior of toner in transfer is greatly dependent upon the charged state of the toner, sharp development without transfer omissions and toner scattering is performed at a high transfer rate by setting a constant current transfer value corresponding to the toner charge amount.

Even if each of the image formation conditions described in the above-mentioned embodiments is set alone, the setting produces its own effects. However, for example, if these image formation conditions are simultaneously set in image adjustment mode during warming-up, they are set to the most preferable image formation conditions suitable for the state of the developing agent, and satisfactory images are formed with stability.

What is claimed is:

1. An image forming apparatus including an image forming body, electrostatic latent image forming means for charging the image forming body to a charging potential Vh (V) by charging means and exposing the image forming body by exposure means to form an electrostatic latent image on the image forming body, developing means for using a two-component developing agent and applying a developing bias voltage obtained by superposing an AC-bias voltage on a DC-bias voltage Vdc (V) to a developing agent carrier to develop the electrostatic latent image formed on the image forming body, thereby forming a toner image on the image forming body, transfer means for transferring the toner image formed on the image forming body onto a recording medium or an intermediate transfer body, cleaning means for cleaning part of the toner image which is not transferred and left on the image forming body, and a controller which controls operation of each of the means, comprising:

a potential sensor which measures a charging potential on the image forming body; and a patch density sensor which detects a toner attraction amount of a patch image, wherein to perform image formation, the controller calculates a toner charge amount Qt ($\mu$C/g) from a potential of a patch image before and after development detected by said potential sensor and an image density of a developed patch image detected by said patch density sensor and sets an image formation condition based on the calculated toner charge amount Qt.

2. An apparatus according to claim 1, wherein setting of the image formation condition is performed using a table which stores in advance the image formation condition corresponding to the toner charge amount Qt.

3. An apparatus according to claim 2, wherein the image formation condition stored in the table is a difference (Vh–Vdc) between the charging potential Vh (V) and the DC-bias voltage Vdc (V).

4. An apparatus according to claim 2, wherein the image formation condition stored in the table is a peak value Vacp-p (V) of the AC-bias voltage.

5. An apparatus according to claim 2, wherein the image formation condition stored in the table is a frequency Fac (kHz) of the AC-bias voltage.

6. An apparatus according to claim 2, wherein the image formation condition stored in the table is the DC-bias voltage Vdc (V).

7. An apparatus according to claim 2, wherein the image formation condition stored in the table is a value vs/vp obtained by dividing a peripheral velocity vs (mm/s) of the developing agent carrier by a peripheral velocity vp (mm/s) of the image forming body.

8. An apparatus according to claim 2, wherein the image formation condition stored in the table is a transfer current Itr (A) used when transferring the toner image onto the recording medium or the immediate transfer body.

9. An apparatus according to claim 2, wherein setting of the image formation condition is performed in image adjustment mode.

10. An apparatus according to claim 2, wherein the two-component developing agent comprises a magnetic carrier and nonmagnetic polymerized toner having a volume average particle size of 3 $\mu$m to 6.5 $\mu$m.

11. An apparatus according to claim 1, wherein setting of the image formation condition is performed in image adjustment mode.

12. An apparatus according to claim 1, wherein the image formation condition comprises a plurality of different image formation conditions corresponding to the toner charge amount Qt, and the plurality of image formation conditions are simultaneously set using a plurality of tables which store in advance the plurality of image formation conditions, respectively.

13. An apparatus according to claim 12, wherein setting of the image formation conditions is performed in image adjustment mode.

14. An apparatus according to claim 1, wherein the two-component developing agent comprises a magnetic carrier and nonmagnetic polymerized toner having a volume average particle size of 3 $\mu$m to 6.5 $\mu$m.

* * * * *